United States Patent [19]

Goad, Sr.

[11] Patent Number: 4,897,578

[45] Date of Patent: Jan. 30, 1990

[54] HIGH EFFICIENCY INCANDESCENT LAMP WITH DIODE RECTIFIER

[76] Inventor: Christopher F. Goad, Sr., 7005 Monument Ave., Richmond, Va. 23226

[21] Appl. No.: 191,405

[22] Filed: May 9, 1988

[51] Int. Cl.[4] ..... H05B 37/00

[52] U.S. Cl. ..... 315/71; 315/200 R; 313/643

[58] Field of Search ..... 315/71, 200 R; 313/42, 313/578, 580, 637, 643

[56] References Cited

U.S. PATENT DOCUMENTS

| | | | |
|---|---|---|---|
| 3,148,305 | 9/1964 | Pearson | 315/51 |
| 3,372,302 | 3/1968 | Fasola | 315/272 |
| 3,450,893 | 6/1969 | Munson | 315/200 R |
| 3,823,339 | 7/1974 | Borneman et al. | 315/69 |
| 3,869,631 | 3/1975 | Anderson et al. | 313/217 |
| 3,963,956 | 6/1976 | Beining | 315/71 |
| 4,435,671 | 3/1984 | Wouk | 315/200 R |
| 4,480,212 | 10/1984 | Monahan et al. | 315/71 |
| 4,516,054 | 5/1985 | Shikama et al. | 315/71 |
| 4,544,861 | 10/1985 | Kretchmar | 315/200 R |

*Primary Examiner*—Eugene R. LaRoche
*Assistant Examiner*—Robert J. Pascal

[57] ABSTRACT

The longevity of an incandescent electric lamp and its efficiency of light production are increased by utilizing a rectifier externally attached to the base of the lamp, and by employing within the glass envelope a gas mixture comprising 75% to 85% krypton and 15% to 25% nitrogen. By virtue of the placement, manner of attachment, and configuration of the rectifier, it dissipates heat to the ambient air and thereby operates at a reduced temperature which increases its performance and longevity.

7 Claims, 2 Drawing Sheets

HIGH EFFICIENCY INCANDESCENT LAMP WITH DIODE RECTIFIER

FIELD OF THE INVENTION

This invention relates to incadescent lamps of the type commonly used in lighting fixtures of houses and industrial buildings. More particularly, it relates to improvements in such lamps for providing extended lamp life and greater operating efficiency.

BACKGROUND ART

The conventional incadescent lamp used for home lighting is commonly known as the A-line gas filled lamp having a wattage between about 25 and 150 watts. The construction parameters for such lamps are substantially uniform among different manufacturers, the lamps being designed for operation from a nominal voltage of 120 volts, 60 cycle AC with standard power ratings of 40, 60, 75, 100 and 150 watts. Such lamps are rated for average operating life, and for standard lamps a rated life of 1,000 hours or less is typical. For convenience, these may be termed short-life lamps as compared with known lamps having extended life ranging upward from 1,000 hours to several years. The primary cause of lamp failure is cohesive failure of the tungsten filament, said filament failure generally being caused by evaporation of tungsten, said evaporation being a temperature-dependent phenomenon.

One way of increasing the life of a given lamp is by operating the tungsten filament at a reduced temperature, as may be achieved by changing the design of the filament. A typical 100 watt lamp has a coiled tungsten wire filament of 0.0635 mm diameter and an uncoiled length of 577 mm. It has an operating temperature of 2577 degrees C. and an average operating life of 750 hours. The life of this lamp could be increased while retaining the same wattage rating by changing the filament configuration so that it operates at a lower temperature; however, the efficiency in terms of lumens per watt would be decreased.

Another way of extending the operating life of an incandescent lamp is to reduce the effective voltage across the filament. This has been done in the prior art by connecting a rectifying diode in series with the filament so that only alternate half cycles of the supply voltage are applied to the filament. This has the effect of reducing the time average value of voltage to about 0.7 of that produced by the unrectified supply voltage. Consequently, the filament is operated at a substantially lower temperature and also at a lower efficiency in terms of lumens per watt. The use of a rectifying diode installed in a socket for a lamp to prolong lamp life is disclosed in U.S. Pat. Nos.: 3,450,893; and 3,963,956. Lamps which incorporate the diode into the structure of the lamp are disclosed in U.S. Pat. Nos.: 3,148,305; 3,869,631; and 4,480,212.

One difficulty encountered in the use of a diode for extending lamp life is that the reduction of effective voltage without a change in the filament design results in a large decrease in filament temperature, and the light output of the lamp is substantially diminished. Operation at the reduced temperature also results in lower efficiency of the filament. For example, the standard 100 watt lamp mentioned above has an operating temperature of 2577 degrees C. without a diode and the light output is 1750 lumens. With a diode in this lamp in series with the filament, the operating temperature is reduced to 2164 degrees C. and the light output is 510 lumens. The diode has the effect of reducing power consumption of the lamp from 100 watts to 58.8 watts. The average life for the lamp without the diode is 750 hours and the same lamp with a diode is 8.6 years.

The above-cited U.S. Pat. No. 4,480,212 recognizes the desirability of shielding the diode from the heat of the filament, and employs toward such objective a reflector within the glass bulb. The positioning of the diode externally to the lamp, namely upon the bottom of the threaded base of the lamp is disclosed in U.S. Pat. Nos. 3,148,305 and 3,823,339. Although such positioning of the diode causes it to be cooler than when enclosed within the glass bulb, further improvement is desirable.

A general object of this invention is to overcome certain disadvantages of the prior art to provide an improved incandescent lamp having an extended operating life and increased efficiency.

It is a further object of the present invention to provide an improved incadescent lamp as in the foregoing object which does not require a specialized filament or additional components within the glass envelope component of the lamp.

These objects and other objects and advantages of the invention will be apparent from the following description.

SUMMARY OF THE INVENTION

The above and other beneficial objects and advantages are accomplished in accordance with the present invention by providing certain improvements in an otherwise conventional incandescent lamp comprising a glass envelope, a coiled tungsten filament disposed within said envelope, a base portion having a threaded metal sleeve, two lead wires extending from said base portion to said filament, and an electrically insulative plug which seals the lowermost portion of said sleeve and anchors one of said lead wires. The improvements of the present invention comprise in combination:

(a) the presence of a gas mixture within said envelope comprised of 75%–85% krypton and the remainder nitrogen, (b) a flat diode rectifier adhered to the exterior surface of the insulative plug and in electrical communication with said anchored lead wire, (c) said adhesion being achieved with a cement of high melting point and comprised of an alloy of 93–98 parts silver and 2–7 parts tin.

In preferred embodiments, the improvements of this invention are applied to A-line incandescent lamps wherein the glass envelope is comprised of a bulb portion and neck portion. However, the improvements may be further applied to flood lights and high wattage lamps. The rectifier is preferably a semi-conductor such as silicon rated for high temperature use.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

Figure 1:
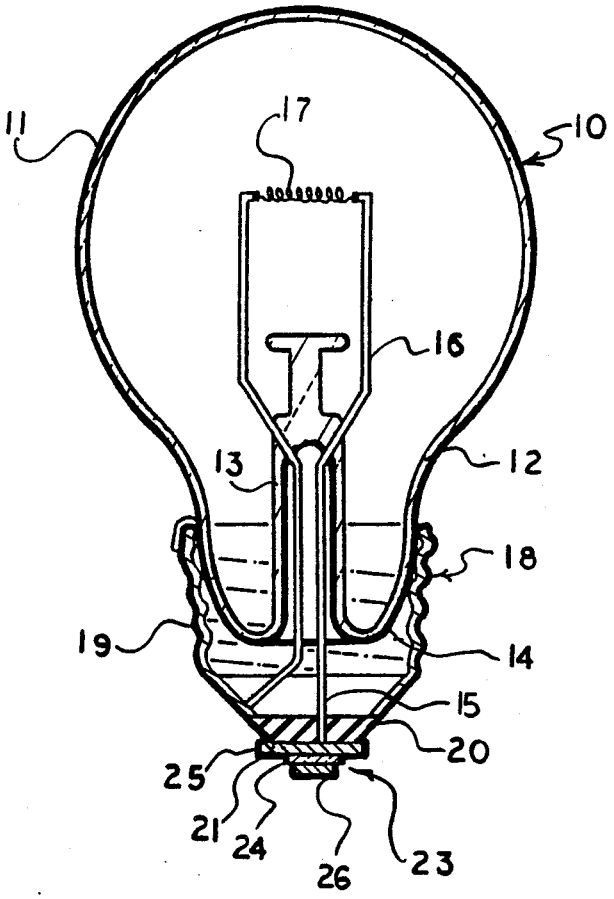
FIG. 1 is a longitudinal sectional view of an embodiment of the improved incandescent lamp of the present invention.

For ease in description, the terms "upper" or "lower" and expressions of equivalent import will have reference to the upper and lower extremities, respectively, of the lamp as illustrated in FIG. 1. Similarly, the terms "interior" or "exterior" and equivalent alternative expressions will have reference to the geometric center of the lamp illustrated in FIG. 1.

DESCRIPTION OF THE PREFERRED EMBODIMENT

Referring now to the drawings, there is shown an embodiment of the invention in an incandescent lamp of the so-called A-line type which are commonly used for home lighting. The lamp comprises a glass envelope 10 including a bulb portion 11 and a neck portion 12. The envelope is completed by the conventional stem press glass mount, referred to herein as the stem 13, the flare 14 of which joins the neck portion 12. The lamp includes a pair of lead-in wires 15 and 16 which extend through stem 13. A coiled tungsten filament 17 is supported by the uppermost extremities of said lead-in wires. The filament is of such wire size and configuration that the lamp operates at its rated wattage with a filament operating temperature less than about 2250 degrees C. At this temperature, the lamp has an extended operating life with good efficiency in terms of lumens per watt.

The lamp is provided with a conventional screw base 18 attached to the neck portion of the envelope. The base is comprised of a threaded metal sleeve 19 and an electrical insulator plug 20 that encapsulates and thereby anchors the lowermost extremity of lead-in wire 15, which may be considered a center wire. The lowermost of exterior face 21 of plug 20 is flat and perpendicularly centered upon long axis 22 of the lamp at a location below sleeve 19. The base is adapted to be received in a conventional lamp socket having a centered contact spring and through which a supply voltage, normally 120 volts AC, 60 cycle, is applied across center wire 15 and sleeve 19. Lead-in wire 16 is connected directly to the sleeve.

The lamp is filled with a gaseous mixture comprising 75%–85% krypton and the balance nitrogen. It has been found that, at less than a 75% krypton concentration, there is a significant loss of lumens of light per watt of energy consumed. At krypton levels above 85%, undesired arcing of the filament to the glass enclosure occurs.

An integrated rectifier diode unit 23 is attached to the flat exterior surface 21 of plug 20. The unit 23 comprises a thin wafer, disc or chip 24 which may comprise a rectifying semi-conductor such as germanium or silicon sandwiched between upper and lower thin contacts or discs 25 and 26, respectively, fabricated of conductive metal or metalized contacts. The upper disc 25 establishes electrical contact with center lead-in wire 15. In the embodiment of FIG. 1, discs 25 and 26, and wafer 24 all have circular perimeters. It is to be noted that the perimeter of chip 24 is exposed to the ambient air.

Thus, the filament 17, the diode, lead-in wires 15 and 16, and the sleeve 14 are in a series electrical circuit. The orientation of the diode, i.e. its polarity in the circuit, is immaterial.

Diode chip 24 may, for example, be silicon, suitably a IN4003 having a peak inverse voltage rating of 400 volts and a current rating of about one ampere. Upper disc 25 is directly adhered to the insulator plug utilizing a high melting point metal alloy comprised of 93% to 98% by weight of silver. Additional components of the alloy may be tin and lead. By virtue of the attachment of the diode at the extremity of the exterior of the lamp and in a manner permitting direct exposure to ambient air, the diode disc does not receive heat from the filament and is capable of dissipating any acquired heat. Accordingly, the diode operates at a lower temperature which prolongs its operating life.

The combination of the critically selected gas mixture and critical placement of the diode produces a synergistic effect which enhances the efficiency and longevity of the lamp.

Figure 2:
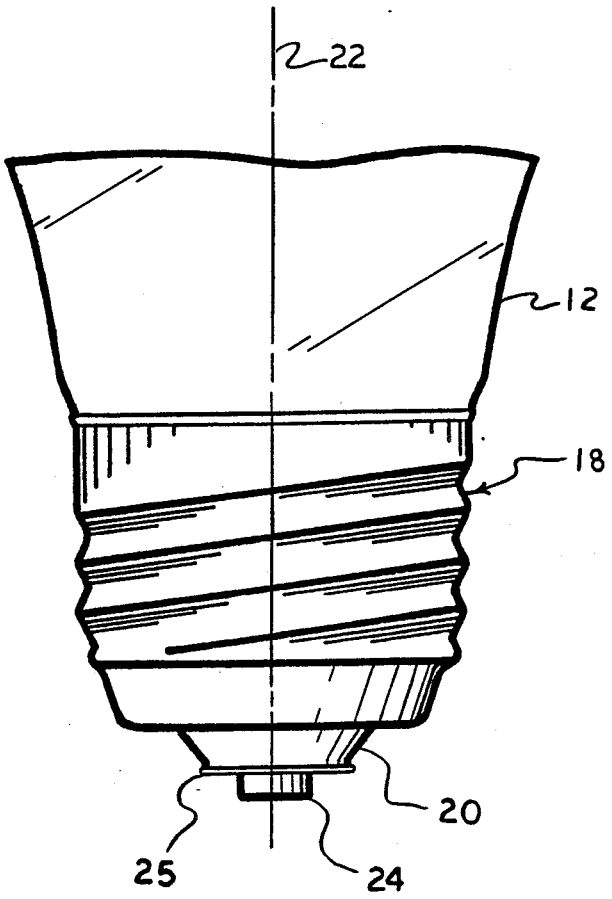
FIG. 2 is an enlarged fragmentary side view of an alternative embodiment of the lamp of FIG. 1.

In the embodiment shown in FIG. 2, lower disc 2 has been omitted, and upper disc 25 is considerably thinner than wafer 24. In said embodiment, the lower surface of the wafer is intended to be directly contacted by the centered contact spring of a lamp socket. Furthermore, by virtue of the exposure of the lower surface of the wafer to the ambient air the dissipation of heat is greatly enhanced, resulting in cooler temperature of the wafer. The light-producing efficiency of the improved lamp is at least 10 lumens/watt.

While particular examples of the present invention have been shown and described, it is apparent that changes and modifications may be made threrein without departing from the invention in its broadest aspects. The aim of the appended claims, therefore, is to cover all such changes and modifications as fall within the true spirit and scope of the invention.

Having thus described my invention, what is claimed is:

1. In an incandescent lamp comprising a glass envelope, a coiled tungsten filament disposed within said envelope, a base portion having a threaded metal sleeve, two lead wires extending from said base portion to said filament, and an electrically insulative plug which seals the lowermost portion of said sleeve and anchors one of said lead wires which terminates in a flat exterior surface of said plug, the improvement comprising in combination:

(a) the presence of a gas mixture within said envelope comprised of 75%–85% krypton and the remainder nitrogen, and (b) a rectifier having flat upper and lower surfaces and a flat semiconductor diode, said rectifier being adhered at said upper surface to the exterior surface of the insulative plug and in electrical communication with said anchored lead wire, (c) said adhesion being achieved with a high melting point alloy comprised of 93–98 parts silver and 2–7 parts tin.

2. The improved lamp of claim 1 wherein said diode has a circular perimeter which is exposed to ambient air.

3. The improved lamp of claim 2 wherein said diode is centered upon the longitudinal axis of said lamp.

4. The improved lamp of claim 3 wherein the lower surface of said rectifier is exposed to ambient air.

5. The improved lamp of claim 4 wherein said rectifier is comprised of a disc of semi-conductor material sandwiched between upper and lower discs of conductive metal.

6. The improved lamp of claim 5 wherein said upper disc of conductive metal constitutes the upper surface of said rectifier, and is adhered to the exterior surface of the insulative plug.

7. The improved lamp of claim 4 wherein said filament operates at a temperature less than about 2250 degrees C. and at a a voltage of about 120 volts.

* * * * *